US005237759A

United States Patent [19]

Chaigne

[11] Patent Number: 5,237,759

[45] Date of Patent: Aug. 24, 1993

[54] TENSION CONTROL DEVICE FOR SKI BOOT

[75] Inventor: Jerome Chaigne, Saint Jorioz, France

[73] Assignee: Salomon S. A., Chavanod, France

[21] Appl. No.: 725,484

[22] Filed: Jul. 3, 1991

[30] Foreign Application Priority Data

Jul. 3, 1990 [FR] France ..... 90 08414

[51] Int. Cl.[5] ..... A43B 11/00

[52] U.S. Cl. ..... 36/117; 36/50.5

[58] Field of Search ..... 36/117-121, 36/50, 51, 54, 50.1, 50.5; 24/68 SK, 69 SK, 71 SK

[56] References Cited

U.S. PATENT DOCUMENTS 4,150,500 4/1979 Delery ..... 36/117
4,802,290 2/1989 Marega ..... 36/119
4,823,484 4/1989 Couty ..... 36/117
4,910,890 3/1990 Morell et al. ..... 36/117
4,934,074 6/1990 Sartor ..... 36/119

*Primary Examiner*—Steven N. Meyers
*Assistant Examiner*—Thomas P. Hilliard
*Attorney, Agent, or Firm*—Pollock, Vande Sande & Priddy

[57] ABSTRACT

A device for controlling the tension of a flexible connector (3), such as a wire, cable, or strap, applicable, in particular, as a tightening device for an alpine ski boot. A projection piece (8) on the base (4) has a central longitudinal groove along which the flexible connector (3) extends to its point of attachment (6*b*) on the tension lever (6). An elastic retainer holds the tension lever (6) on the base (4) in open position, but in the event of shock to the tension lever (6), the second end (15, 16) of the lever (6) disengages from a stop (11) and moves to the outside of the projection piece (8).

11 Claims, 5 Drawing Sheets

TENSION CONTROL DEVICE FOR SKI BOOT

FIELD OF THE INVENTION

The present invention concerns a device for control of a flexible connector, such as a wire or cable, using a movable tension lever, and is applicable, more specifically but not exclusively, as a tightening mechanism for a sport article such as an alpine ski boot.

BACKGROUND OF THE INVENTION

Conventionally, alpine ski boots practice in the filed alpine ski boots calls for equipping these boots are provided with various tightening devices which are generally intended to eliminate, or at least markedly reduce, the play between the lower part of the leg or the foot of a skier and the boot worn by the skier. Devices may be provided, most notably, to tighten the upper around the lower part of the skier's leg, or to secure the foot inside the lower part of the shell. Known tightening mechanisms generally comprise a flexible connector, such as a wire, cable, or strap, one of whose ends is hooked onto a movable tension lever mounted on a base fastened on an appropriate part of the boot. The tension lever can be moved to a closed position in which it is flattened on its base and keeps the flexible connector under tension, this position corresponding to the desired level of tightness, or to an open position in which the lever is drawn away from its base and the flexible connector is relaxed, this arrangement corresponding to the loosened position. In most tightening devices of this kind, the lever is jointed onto the base about an axis, so that the lever and the base constitute a unit. This type of construction is not entirely satisfactory, since it does not provide every possible assurance of safety; in fact, in the open position, the tension lever forms an outwardly-extending angle with its base, and thus projects outward from the wall of the surrounding boot to which it is attached, in such a way that it can be damaged or torn off when it collides with an obstacle.

To overcome this difficulty, tightening devices are known in which the tension lever is "free" and is, in the closed position, kept pressed against a stop solely under the effect of the tension of the flexible connector. A tightening device of this kind is described, for example, in CH-614358 and FR-A-2 373 981. Because of this simple support arrangement, the tension lever can, when projecting outward, be easily ejected from the stop holding it, thereby making it possible to very appreciably reduce the risks that the lever will be damaged or torn away.

SUMMARY OF THE INVENTION

The present invention concerns improvements made to a device for the tension control of a flexible connector of the type embodying a "free" tension lever, for the purpose of facilitating both manufacture and use.

To this end, this device for the tension control of a flexible connector, such as a wire, cable, or strap, is applicable, in particular, as a tightening device for a sport article such as an alpine ski boot. It comprises a base and a tension lever mounted so as to e movable in relation to the base, this lever having a first movable longitudinal end for maneuvering and a second longitudinal end connecting with the base and being attached to the flexible connector at a point of attachment intermediate between its two ends. The base comprising a projection piece forming a stop for the second end of the tension lever which end has a curved surface allowing the tension lever to pivot when the second end is pressed against the stop and is held by this latter, around a transverse axis. The projection piece on the base has a central longitudinal groove along which the flexible connector passes as it extends to its point of attachment on the tension lever, and elastic retention means hold the tension lever on the base in the open position in which this lever, still pressed against the stop, is inclined in relation to the base. In the event of shock to the tension lever, however, the retention means permit the second end of the lever to disengage from the stop and to more to the outside of the projection piece.

BRIEF DESCRIPTION OF THE DRAWINGS

Various embodiments of the present invention will now be described by way of example and with reference to the attached drawings.

DESCRIPTION OF PREFERRED EMBODIMENT

Figure 1:
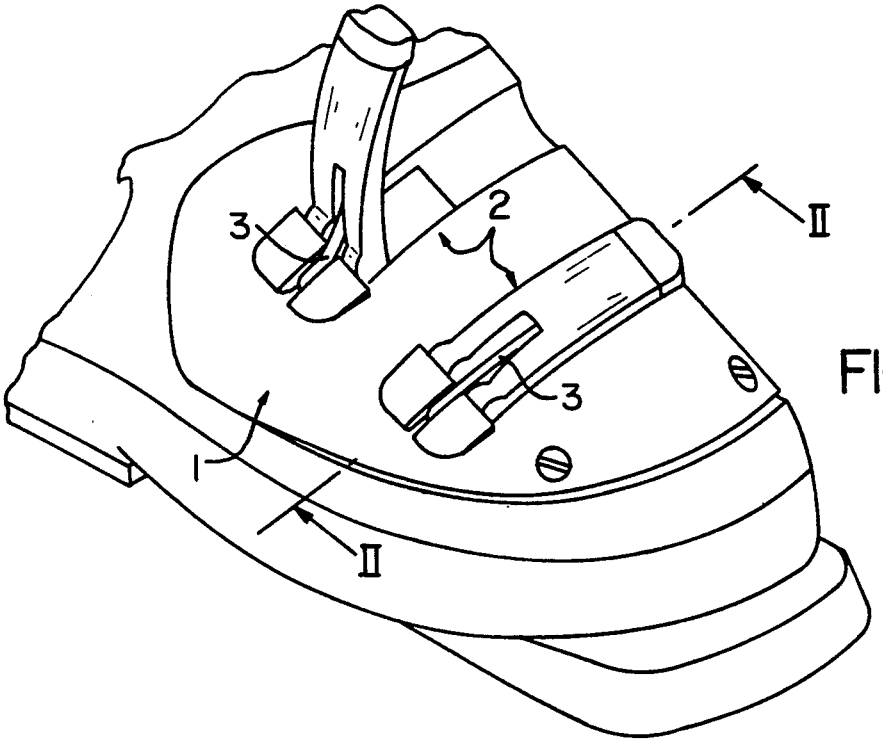
FIG. 1 is a perspective view of the front part of an alpine ski boot equipped with two tightening mechanisms according to the invention mounted on the base of the shell of this boot, the mechanisms being shown with their tension levers in closed and open positions, respectively.

FIG. 1 shows the front part of the shell base 1 of an alpine ski boot, on which are mounted two devices 2 for control of the tension of a respective flexible connector 3, such as a wire or cable. In this particular application, each of the mechanisms 2 is designed to control, by means of the flexible connector 3 associated with it, the movement of an internal tightening device which makes it possible to secure the skier's foot inside the boot. Each of the tightening mechanisms 2 comprises a base 4, preferably made of a molded plastic material, which is inserted, and secured inside an opening 5 of suitable provided in the wall of the shell base 1. The base 4 has mounted on it a movable tension lever 6, of the "free" type, i.e., which is not permanently connected to the base by any jointing mechanism whatever, such as a pin, and which can be maneuvered by acting on a first movable longitudinal end 6*a* thereof.

The base 4 comprises a base plate 7, which extends across the opening 5 of the shell, base 1 and which has, preferably, a slightly upward convexity. A projection piece 8 formed at its left end is inserted through the opening 5 and extends laterally a little beyond this opening, so that its edge 8*a* covers somewhat the edge of the opening 5. This projection piece forms, in conjunction with the base plate 7, a single piece which is substantially rectangular and symmetrical in relation to the vertical and longitudinal plane XX' of the base 4, which extends transversely in relation to the shell base 1. In this projection piece 8, in the plane of symmetry XX', there is a central longitudinal groove 9 whose bottom connects with the upper surface of the base plate 7. This longitudinal groove 9, which opens into the left edge and the upper side of the projection piece 7, diverges downwardly. The flexible connector 3 runs longitudinally along the bottom of the groove and has a diameter more or less equal to the width of the bottom of the groove. Accordingly, the two walls of the groove 9, which converge slightly outward, form elastic means for the upward position-retention of the flexible connector, because when the flexible connector 3 passes across the narrow upper inlet of the groove 9, the relatively rigid flexible connector 3 either elastically pushes the edges of the groove inlet transversely or is elastically crushed to some degree by the relatively stiff rigid edges of the inlet of the groove 9. Thus, the flexible connector 3 cannot freely come out of the groove 9, because of the narrowness of the upper inlet of this latter. This flexible connector 3, which originates inside the shell base 1, penetrates into one end of the groove 9 and exits at the other end, so as to enter longitudinally into tension lever 6 to which it is connected at a point of attachment 6*b* intermediate between its ends.

The projection piece 8 has, on the side turned toward the tension lever, i.e., opposite the side on which the flexible connector 3 penetrates into the projection piece 8, a stop 11 having a concave cylindrical surface by means of which it attaches to the upper surface of the base plate 7 and in the middle of which the groove 9 opens out. This surface is formed by a portion of a cylinder generated by rotation and having an axis A which is transverse in relation to the tension lever 6, i.e., perpendicular to the vertical longitudinal plane of symmetry XX' of the base 4, and its directrix is an arc of a circle of approximately 180°. The second longitudinal end of the tension lever 6 is supported on the stop 11 incorporating a cylindrical surface. In fact, the lever 6 ends, opposite the stop 11, in two parallel, spaced longitudinal arms 12, 13. The two terminal arms 12, 13 together delimit a slot 14 through which, as it leaves the groove 9, the flexible connector 3 passes before penetrating axially into the tension lever 6 to which it is hooked at point 6*b*. The ends 15, 16 of the terminal arms 12, 13 have cylindrical surfaces generated by rotation which have a shared transverse axis B and the same radius of curvature as the cylindrical-surface stop 11. When the tension lever 6 is resting on the cylindrical-surface stop 11, axis A of the stop and axis B of the cylindrical ends 15, 16 of the lever 6 coincide, as shown in FIG. 2.

Figure 2:
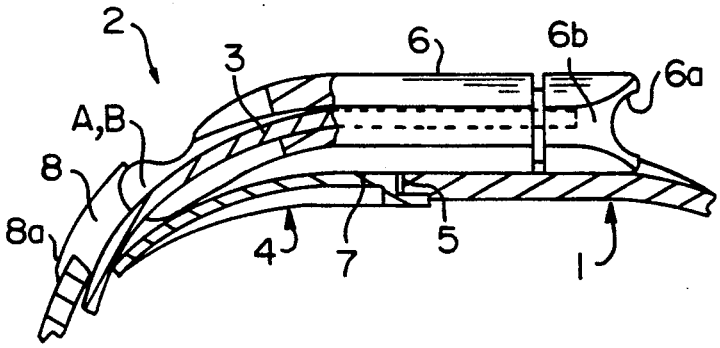
FIG. 2 is a cross-section view taken vertically and partially transversely along line II—II in FIG. 1, the tension lever being shown in closed position.
Figure 3:
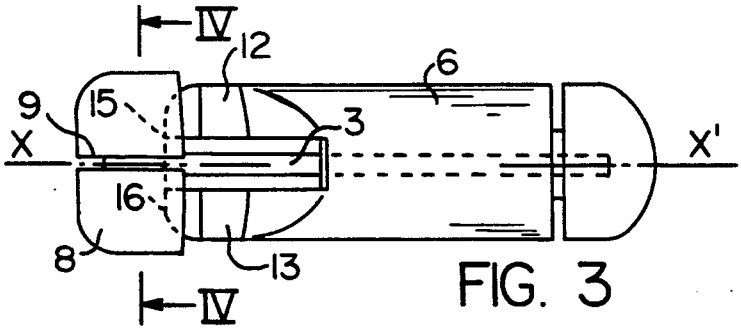
FIG. 3 is a plan view of the tightening mechanism shown in FIG. 2 with the tension lever in closed position.
Figure 4:
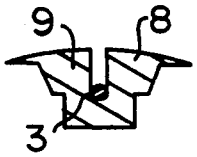
FIG. 4 is a cross-section view along line IV—IV in FIG. 3.
Figure 5:
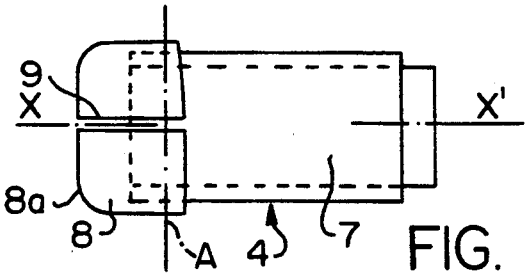
FIG. 5 is a plan view of the base of the tightening mechanism illustrated in FIGS. 1 to 4.
Figure 6:
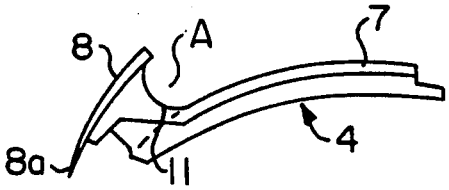
FIG. 6 is an elevation view of the base illustrated in FIG. 5.
Figure 7:
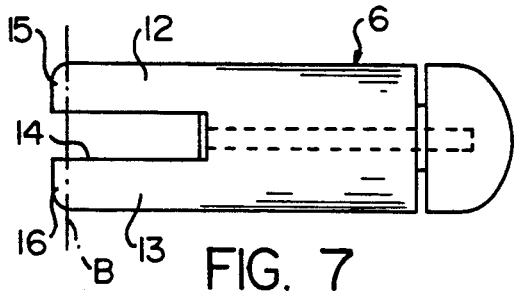
FIG. 7 is a plan view of the tension lever of the tightening mechanism illustrated in FIG. 2.
Figure 8:
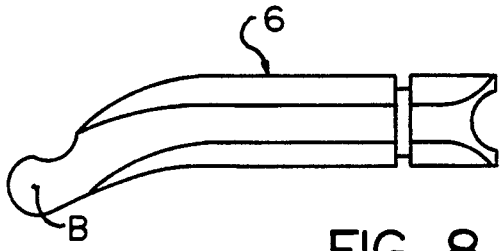
FIG. 8 is a side view of the tension lever in FIG. 7.

In the closed or tightened position, the tension lever 6 lies flat on the base plate 7 of the base 4, as shown in FIG. 2, and is held in that position under the effect of the tension of the flexible connector 3, which runs beneath the pivot axis A, B of the tension lever 6 on the base 4. In fact, the tension to which the flexible connector 3 is subjected generates a moment of forces which draws the tension lever 6 toward the base 4.

Figure 9:
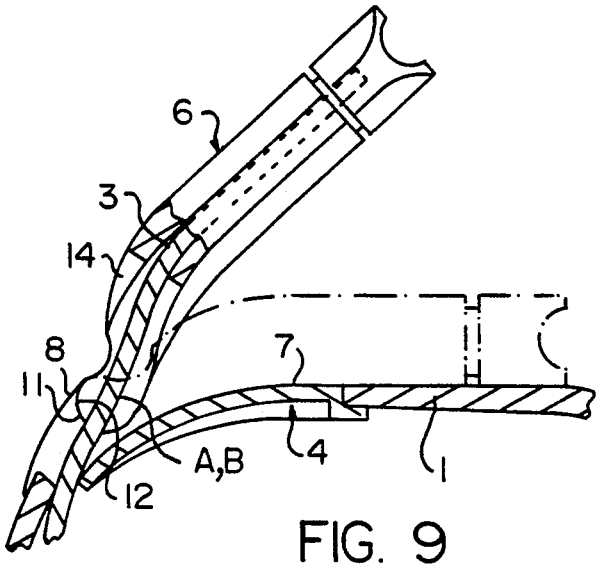
FIG. 9 is a vertical and transverse cross-section view, similar to that in FIG. 2, of the tightening mechanism, the tension lever being illustrated in the open position in which the flexible connector is loosened.

If the skier wishes to relax the tension of the flexible connector 3, i.e. to loosen his foot, he raises the tension lever 6 by causing it to pivot counter-clockwise around the common axis A, B, so to draw it into the raised, or open, position as illustrated in FIG. 9. In this raised position of the tension lever 6, the flexible connector 3, which is still engaged and held in the bottom of the groove 9, becomes loosened because the connector then runs more or less through the common pivot axis A, B, and its path to the point of attachment 6*b* on the lever 6 is shorter. The residual tension of the flexible connector 3, which has a lesser value, is nevertheless sufficient to hold the ends 15, 16 of the lever 6 engaged in the stop 11.

Figure 10:
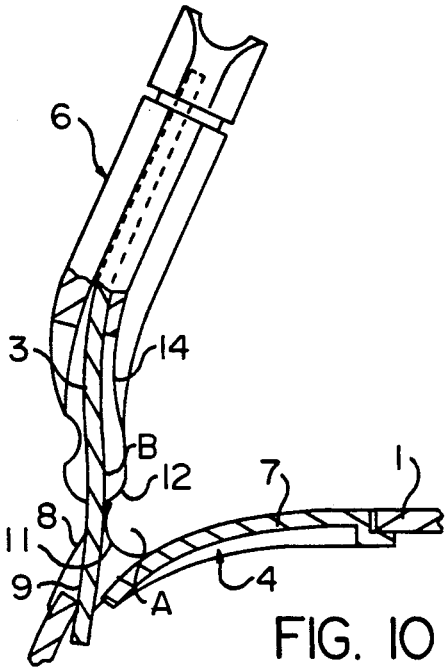
FIG. 10 is a vertical, transverse cross-section view, similar to that in FIG. 2, of the tightening mechanism, the tension lever being shown disengaged from its stop.
Figure 11:
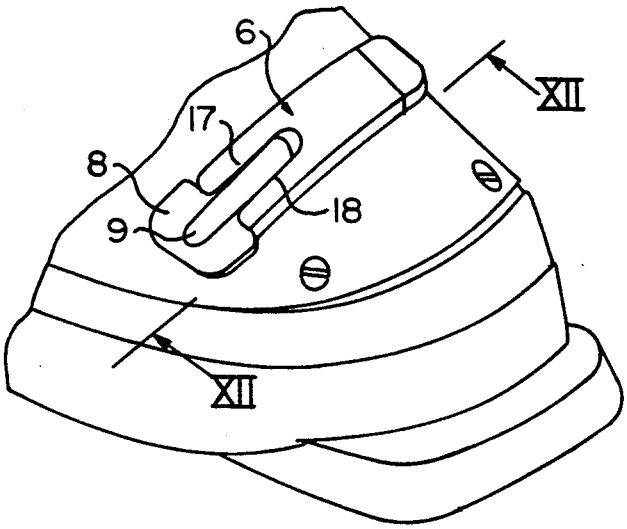
FIG. 11 is a partial perspective view of a variant of a tightening mechanism mounted on the shell base of an alpine ski boot, the tension lever being in closed position.

FIG. 10 shows the tension lever 6 disengaged above the stop 11 of the base 4, the tension lever then being released and being retained only by the flexible connector 3. This may result from a shock to the tension lever 6 in the open position illustrated in FIG. 9, a shock severe enough to eject the cylindrical ends 15, 16 of the tension lever 6 from the cylindrical stop 11 and to force the flexible connector to leave the groove 9 while remaining, however, gripped in its narrow upper inlet. This ejection of the tension lever 6 in the event of shock makes it possible to avoid damage or entire detachment of the lever 6.

In the embodiment illustrated in FIGS. 11 to 19, the projection piece 8 is extended toward the right and above the base plate 7 by means of two thin vertical longitudinal wings 17, 18 originating in the central part of the stop 11 incorporating a concave cylindrical surface and extending over a portion of the length of the base plate 7, to which they are attached. These two relatively elastic wings 17, 18 delimit a central narrow groove 19 which forms an extension of the groove 9 in the projection piece 8. In this instance, the grooves 9 and 19 have a constant width which is substantially equal to the diameter of the flexible connector 3, so that the flexible connector can be freely engaged in or disengaged from these grooves.

The wings 17 and 18 extend between the two terminal longitudinal arms 12, 13 of the tension lever 6, which is connected to these wings 17 and 18 by latching or elastic locking devices formed on the pairs of adjacent sides of the arms 12, 13 of the tension lever 6 and of the wings 17 and 18. These latching devices comprise at least one boss on one of the surfaces of each pair of adjacent surfaces and a locking recess which houses this boss on the other adjacent surface, the recesses and bosses being transversely aligned. For example, in one embodiment, the wings 17, 18 have respective, relatively thin central areas 17*a*, 18*a*, whose outer sides are bordered by upper marginal flanges 17*b*, 18*b* and marginal frontal, substantially flanges 17*c*, 18*c*, all of these flanges projecting outward from the external surfaces of the two wings 17, 18. The thin central areas 17*a*, 18*a*, which form locking recesses in relation to the marginal flanges 17*b*, 18*b*, 17*c*, 18*c*, work in conjunction with bosses on the internal surfaces of the two terminal longitudinal arms 12, 13 of the tension lever 6. These arms 12, 13 also have a pair of first bosses 21 22, which face each other and are transversely aligned more or less along axis B of the cylindrical ends 15, 16 of the tension lever 6, i.e., along its pivot axis. The two arms 12, 13 also support, on their internal surfaces, a pair of transversely aligned second bosses 23, 24, which are positioned farther away from the respective cylindrical ends 15, 16 of the arms 12, 13 than are the first bosses 21, 22. The second bosses 23, 24 preferably are less thick than the first bosses 21, 22.

Figure 12:
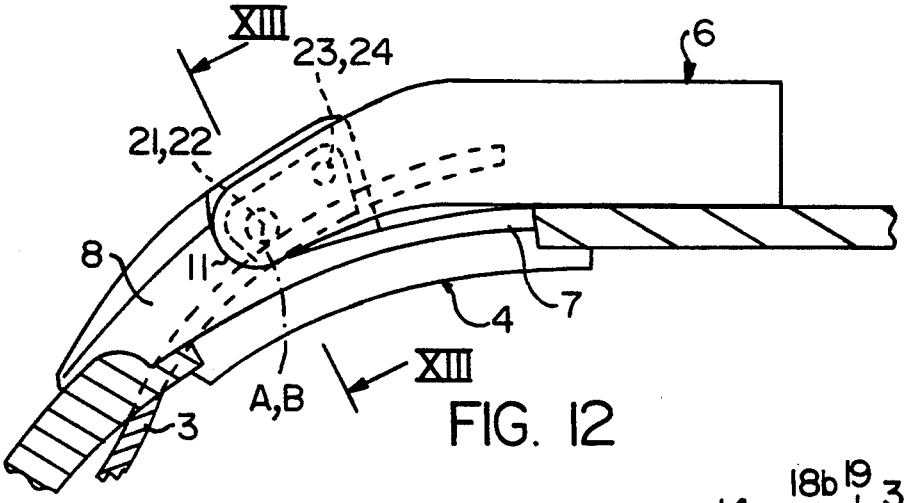
FIG. 12 is a vertical, transverse cross-section view along line XII—XII in FIG. 11.
Figure 13:
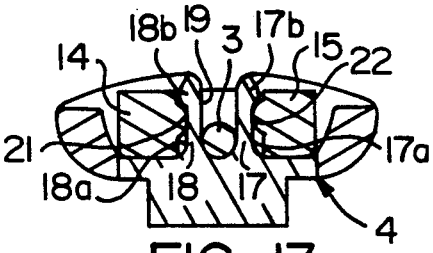
FIG. 13 is a cross-section view along line XIII—XIII in FIG. 12.
Figure 14:
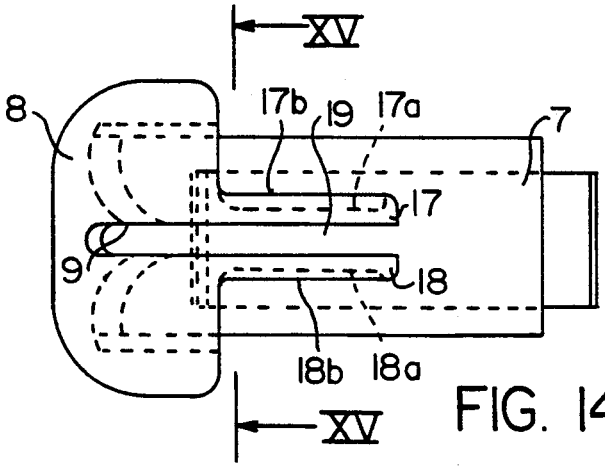
FIG. 14 is a plan view of the base of the tightening mechanism as illustrated in FIGS. 11 to 13.
Figure 15:
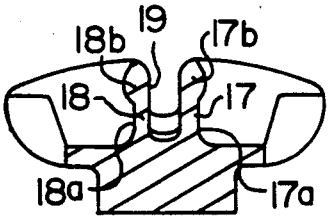
FIG. 15 is a cross-section view along line XV—XV in FIG. 14.
Figure 16:
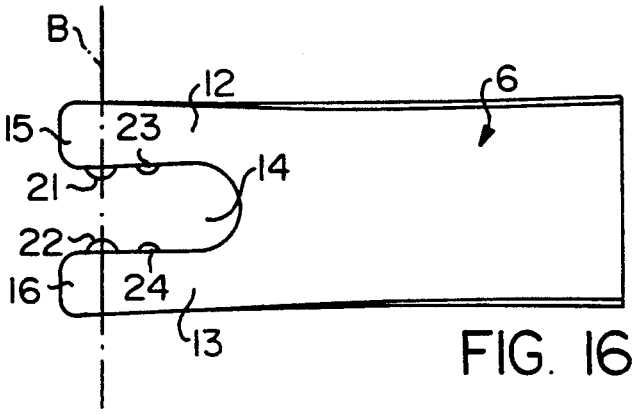
FIG. 16 is a plan view of the tension lever of the tightening mechanism as illustrated in FIGS. 11 to 13.
Figure 17:
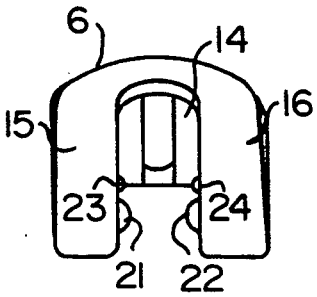
FIG. 17 is a side view of the tension lever, as seen from the left in FIG. 16.

In the closed position of the tension lever, i.e., the flexible connector-tightening 3 position, as shown in FIG. 12, the four bosses 21, 22, 23, 24 are engaged in the locking recesses 17*a*, 18*a* of the respective wings 17, 18. The cylindrical ends 15, 16 of the arms 12, 13 of the tension lever 6 are pressed against the cylindrical stop 11, under the effect of the tension generated by the flexible connector 3, and the tension lever is held flattened on the base 4. In this position, the transverse axis B of the first bosses 21, 22 becomes substantially coincides with axis A of the cylindrical stop 11.

Figure 18:
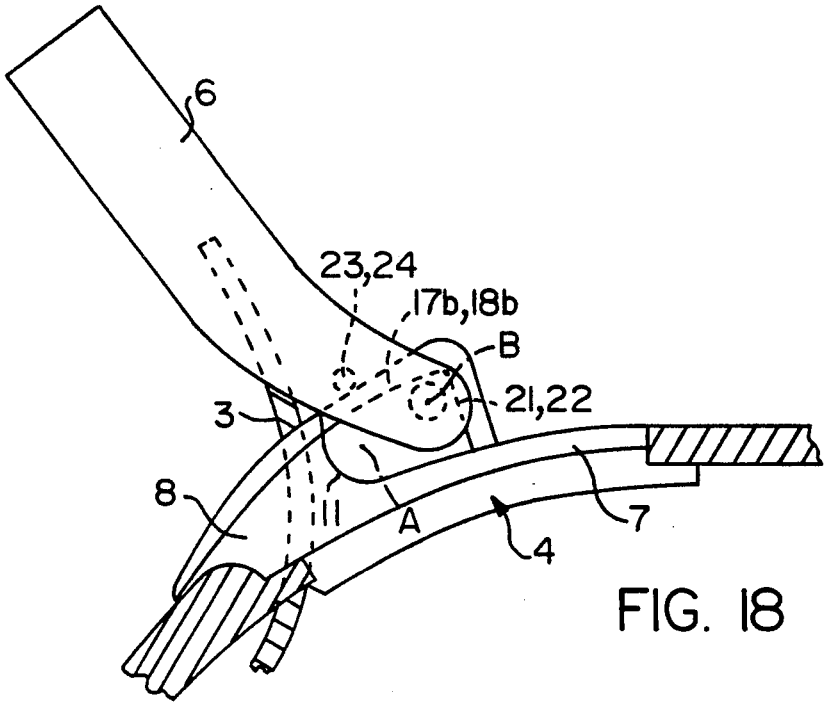
FIG. 18 is a cross-section view, similar to that in FIG. 12, of the tightening mechanism with its tension lever in the open position in which the flexible connector is loosened.

If the skier raises the tension lever 6 in order to move it to the open position, as represented in FIG. 18, the lever initially pivots upward around the common axis A, B and, at a certain point during the resulting upward motion, the second bosses 23, 24 encounter the upper flanges 17*b*, 18*b* of the wings 17, 18. Because of the elasticity of these wings (and/or of lateral arms 12, 13, The bosses 23, 24, which have a relatively slight thickness, then push the two wings together sufficiently to enable them to disengage from the locking recesses 17*a*, 18*a* as they travel over the flanges 17*b*, 18*b*, as shown in FIG. 18. The flexible connector 3 then takes on slack and the entire device is loosened. Nevertheless, the tension lever 6 remains connected to the base 4, because its first bosses 21, 22 are still held in the locking recesses 17*a*, 18*a* in which they are engaged. However, the lever 6 exhibits a certain degree of potential mobility made possible by the movement of the first bosses 21, 22 in the locking recesses 17*a*, 17*b*.

Figure 19:
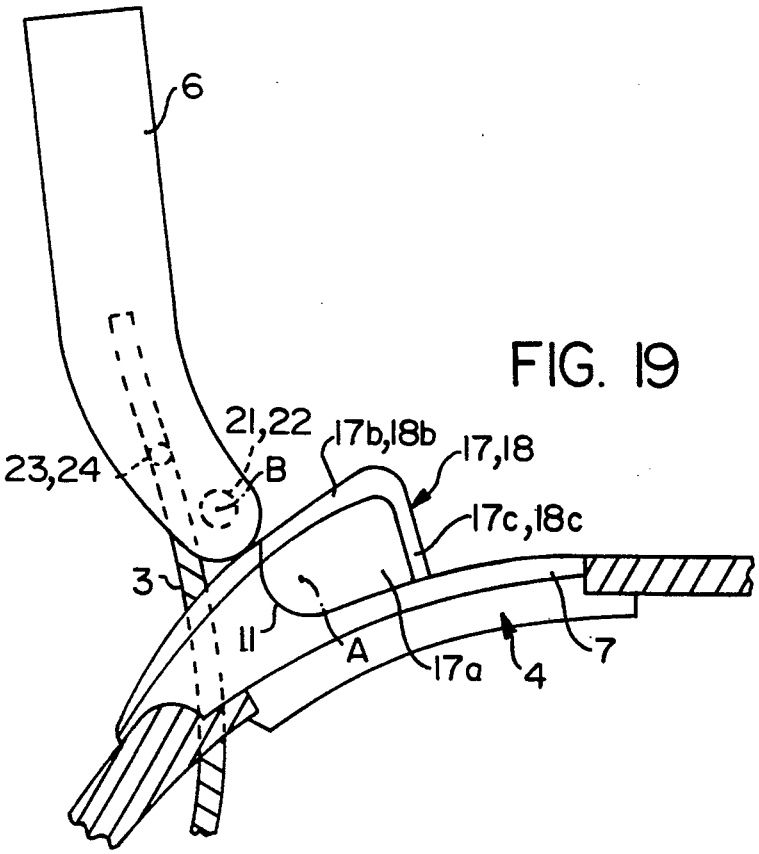
FIG. 19 is a cross-section view, similar to that in FIG. 12, of the tightening mechanism with its tension lever disengaged from its stop.
Figure 20:
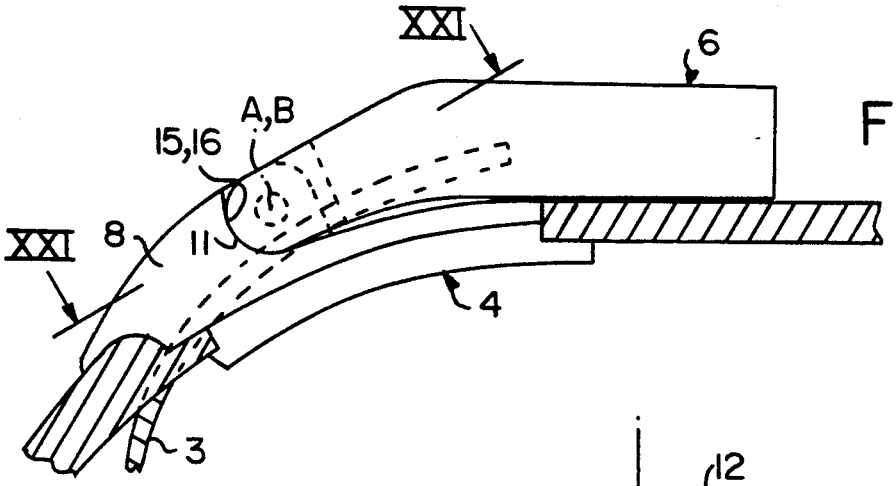
FIG. 20 is an elevation view of another variant of the tightening mechanism, in closed position.
Figure 21:
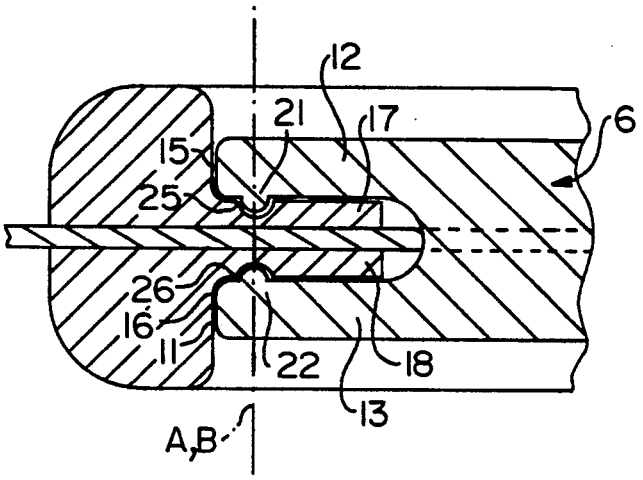
FIG. 21 is a cross-section view on a larger scale along line XXI—XXI of the tightening mechanism illustrated in FIG. 20.
Figure 22:
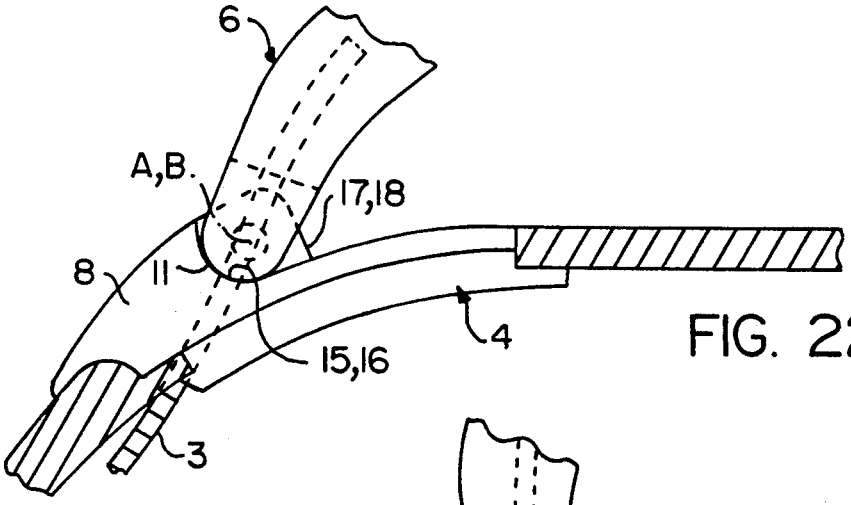
FIGS. 22 and 23 are elevation views of the tightening mechanism in FIG. 20, with its tension lever illustrated in the closed position and disengaged from its stop, respectively.

In the event of shock to the lever 6, the latter can easily separate from the base 4, as shown in FIG. 19. This separation is possible because the first bosses 21, 22 can, in turn, disengage from the locking recesses 17*a*, 18*a* by clearing the upper flanges 17*b*, 18*b*, because of the elasticity of the wings 17, 18 (and/or of the lateral arms 12, 13). From this point on, the lever 6 is held only by the flexible connector 3. The re-engagement of the tension lever 6 in the locking recesses 17*a*, 18*a* of the wings 17, 18 is easily effected, as a result of the elasticity of the material which makes up these wings (and/or the lateral arms 12, 13).

The arrangement of the bosses, 21, 22, 23, 24 and of the locking recesses 17*a*, 18*a* could also be reversed, the bosses 21, 22, 23, 24 then projecting outward from the external surfaces of the longitudinal wings 17, 18 and the locking recesses being formed in the internal surfaces of the longitudinal arms 12, 13 of the tension lever 6.

It should be noted that, because the first bosses 21, 22 are thicker than the second bosses 23, 24, the stress required to separate the lever 6 from the base 4 is greater than that required for shifting from the closed to the open position, and vice versa.

Figure 23:
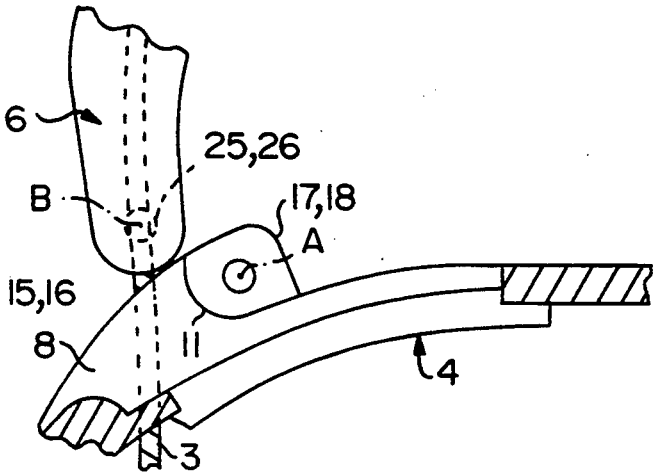

FIGS. 20 to 23 illustrate an embodiment of the device described above with reference to FIGS. 11 to 19. In this embodiment, the two terminal longitudinal arms 12, 13 of the tension lever 6 bear only, on their internal surfaces, the pair of first bosses 21, 22 aligned transversely along axis B. These bosses 21, 22 are engaged in the recesses 25, 26, respectively, whose dimensions correspond to those of the bosses, so that the latter are secured in the recesses 25, 26, while forming the common hinge pin A, B for the tension lever 6. When shock is applied to the lever 6, the bosses 21, 22 can disengage from the recesses 25, 26 because of the elasticity of the terminal arms 12, 13 of the lever 6 and/or of that of the wings 17, 18, thereby allowing the ends 15, 16 of the arms 12, 13 to disengage from the stop 11 and to travel above the projection piece 8, as shown in FIG. 23.

In a conventional manner, the tension lever 6 may be provided with means for adjusting the tension of the flexible connector 3 as desired, these means comprising, for example, a knurled knob engaged on a screw which is itself connected to the flexible connector 3, or several notches spaced longitudinally beneath the tension lever 6, for the connection of a loop formed by the flexible connector 3.

Furthermore, the stop 11 may have a shape other than the curved shape described. In particular, it could form a throat having a V-shaped transverse section, thus constituting a rotation bearing for the curved-surface end piece of the tension lever 6.

I claim:

1. Device for control of the tension of a flexible connector (3), applicable as a tightening device for a ski boot, said device comprising (a) a base (4);

(b) a tension lever (6) mounted so as to be movable in relation to said base (4), said tension lever having a first movable longitudinal end (6*a*) for operating said tension lever and a second longitudinal end connecting with said base (4) and being attached to a flexible connector (3) at a point of attachment (6*b*) intermediate between said first and second longitudinal ends;

(c) said base (4) comprising a projection piece (8) forming a stop (11) for said second end (15, 16) of said tension lever (6) and having a curved surface allowing said tension lever (6) to pivot, when said second end (15, 16) of said tension lever is pressed against said stop (11) and held by said stop, about a transverse axis (A, B);

(d) said projection piece (8) having an open central longitudinal groove (a) guiding said flexible connector (3) as it extends to its point of attachment (6*b*) on said tension lever (6); and (e) elastic retention means for holding said tension lever (6) on said base (4) in an open position in which said tension lever, still pressed against said stop (11), is inclined in relation to said base (4), said retention means, in the event of shock to said tension lever (6), permitting disengagement of said second end (15, 16) of said tension lever (6) from said stop (11) and travel of said second end to an outside of said projection piece (8);

(f) said tension lever (6) comprising, opposite said projection piece (8), two parallel, spaced longitudinal terminal arms (12, 13) which delimit a slot (14) in which said flexible connector (3) emerging from said groove (9) in said projection piece (8) runs before penetrating axially into said tension lever (6) to which it is connected, ends (15, 16) of said terminal arms (12, 13) having convex cylindrical surfaces engaged in said stop (11).

2. Device according to claim 1, wherein said stop (11) has a concave cylindrical surface connecting with an upper surface of a base plate (7) of said base (4) which base plate (7) is unitary with said projection piece (8).

3. Device according to claim 2, wherein said stop (11) has a concave cylindrical surface whose directrix is a circular arc of approximately 180°.

4. Device according to claim 1, wherein said elastic retention means are formed by edges of an inlet opening of said groove (9), said groove having a bottom wider than said inlet opening and substantially equal in diameter with said flexible connector(3).

5. Device according to claim 2, wherein said projection piece (8) is extended, above said base plate (7) of said base (4), by a pair of thin longitudinal wings (17, 18) extending over a part of a length of said base plate (7) to which said wings are attached, said wings being relatively elastic and delimiting a groove (19) forming an extension of said longitudinal groove (9) in said projection piece, and said device further comprises latching or elastic-locking means (21–24, 17*a*, 18*a*) between adjacent surfaces of said pair of longitudinal wings (17, 18) and of said end piece of said tension lever (6) in contact with said stop (11).

6. Device according to claim 5, wherein said tension lever (6) comprises, opposite said projection piece (8), two parallel, spaced longitudinal terminal arms (12, 13) which delimit a slot (14) in which said pair of thin longitudinal wings (17, 18) is engaged, said ends (15, 16) of said longitudinal arms (12, 13) of said tension lever (6) having convex cylindrical surfaces having a common transverse pivot axis (B) and being engaged in said stop (11) having a concave cylindrical surface, said latching or elastic-locking connection means (21–24, 17*a*, 18*a*) being fitted between internal surfaces of said terminal longitudinal arms (12, 13) of said tension lever (6) and external surfaces of said longitudinal wings (17, 18).

7. Device according to claim 6, wherein said latching or elastic-locking connection means comprise a pair of first bosses (21,22) each formed on one of the two adjacent surfaces of one longitudinal wing (17, 18) and of said tension lever (6), said first bosses (21, 22) being aligned transversely, substantially along said pivot axis (B) of said tension lever (6), and a pair of recessed areas (17*a*, 18*a*; 25, 26) formed in the other adjacent surface and in which said first bosses are engaged (21, 22).

8. Device according to claim 7, wherein said latching or elastic-locking connection means comprise a pair of second bosses (23, 24) formed on the surface bearing said first bosses (21, 22) engaged in said recessed areas (17*a*, 18*a*) formed in said other adjacent surface, and which are more remote from said stop (11) than said first bosses (21, 22).

9. Device according to claim 8, wherein said first bosses (21, 22) have a thickness greater than said second bosses (23, 24).

10. Device according to claim 7, wherein each recessed area (17*a* 18*a*) is delimited by marginal flanges (17*b*, 17*c*, 18*b*, 18*c*).

11. Device according to claim 7, wherein said recesses (25, 26) are transversely aligned along an axis (A) and have dimensions corresponding to dimensions of said first bosses (21, 22), so that said first bosses are retained in said recesses (25, 26), thus giving material form to said pivot axis (A, B) of said tension lever (6).

* * * * *